US006092777A

United States Patent [19]

Kuntz

[11] Patent Number: 6,092,777

[45] Date of Patent: Jul. 25, 2000

[54] ADJUSTABLE CEILING SUSPENSION SYSTEM

[75] Inventor: William E. Kuntz, Ellicott City, Md.

[73] Assignee: Eagle Inventors, LLC, Rehoboth Beach, Del.

[21] Appl. No.: 08/961,218

[22] Filed: Oct. 30, 1997

[51] Int. Cl.[7] ..... A47H 1/00

[52] U.S. Cl. ..... 248/323; 248/343

[58] Field of Search ..... 248/323, 61, 63, 248/320, 343, 298.1, 329; 52/28, 39, 506.09

[56] References Cited

U.S. PATENT DOCUMENTS

| | | | |
|---|---|---|---|
| 2,854,824 | 10/1958 | Curry et al. | 405/302.1 |
| 2,977,460 | 3/1961 | Franck | 362/309 |
| 3,685,235 | 8/1972 | Lang | 52/39 |
| 3,719,818 | 3/1973 | Porter et al. | 240/52 R |
| 3,740,123 | 6/1973 | Leitl | 350/305 |
| 3,748,793 | 7/1973 | Tompkins et al. | 52/64 |
| 3,843,995 | 10/1974 | Merrill | 16/97 |
| 3,944,180 | 3/1976 | Rogers | 248/323 |
| 3,973,368 | 8/1976 | Moeller | 52/476 |
| 4,037,098 | 7/1977 | Kowalski | 240/78 R |
| 4,065,090 | 12/1977 | Mauney | 248/318 |
| 4,318,252 | 3/1982 | Janson | 52/39 |
| 4,319,421 | 3/1982 | Diamond | 40/617 |
| 4,354,653 | 10/1982 | Ericsson | 248/317 |
| 4,431,081 | 2/1984 | Gagnon et al. | 182/36 |
| 4,601,453 | 7/1986 | Kagan | 248/329 |
| 4,738,369 | 4/1988 | Desjardins | 211/113 |
| 4,826,120 | 5/1989 | Newton et al. | 248/221.4 |
| 5,020,296 | 6/1991 | Aoshika | 52/741 |
| 5,063,636 | 11/1991 | Dickson | 16/98 |
| 5,381,991 | 1/1995 | Stocker | 248/206.5 |
| 5,456,383 | 10/1995 | Polvere et al. | 221/282 |
| 5,478,039 | 12/1995 | Wright | 248/341 |
| 5,480,116 | 1/1996 | Callas | 248/228.4 |
| 5,862,925 | 1/1999 | Grzywinski | 211/162 |

*Primary Examiner*—Anita M. King
*Assistant Examiner*—Gwendolyn Baxter
*Attorney, Agent, or Firm*—Sterne, Kessler, Goldstein & Fox P.L.L.C.

[57] ABSTRACT

An adjustable suspension system is provided for use from a ceiling. The system effectively comprises a grid including grooves interrupted by recesses. At least one suspension means having a base or retainer adjacent it proximal end depends from the system. The suspension device and associated retainer are free to move along the grooves to relocate the object(s) being suspended therefrom. The retainer rests within a recess to maintain the suspension device in the desired location.

8 Claims, 7 Drawing Sheets

ADJUSTABLE CEILING SUSPENSION SYSTEM

FIELD OF THE INVENTION

This invention relates generally to an adjustable ceiling suspension system, and more particularly to a ceiling system from which object(s) may be hung, wherein the suspension means is movable, but remains in place at the desired location.

BACKGROUND OF THE INVENTION

The ability to hang objects from a ceiling provides several advantages. It increases the useable space within a room, provides a variety of display options, and allows support away from the walls of a room. However, attachment to a ceiling can often be difficult. Gypsum board and other hard ceilings normally require a permanent type attachment which cannot be moved and requires patching and repair if removed. Drop ceilings utilizing acoustical ceiling tiles normally do not provide sufficient strength to hold objects.

Previous solutions to the problem of movably hanging objects from ceilings have involved tracks added to ceilings (U.S. Pat. No. 4,738,369). The track type system requires a track to be added to the ceiling. This solution normally limits the area in which the hanging objects can be moved. Additionally, these types of systems do not effectively retain objects at the desired location.

An alternative solution to this problem has been the utilization of replacement ceiling panels tiles designed for attachment (see, for example, U.S. Pat. No. 4,319,421). The replacement type system does not allow the objects to be moved while hanging. The object needs to be removed from the ceiling tile, then the ceiling tile is removed and relocated. The object or a different object can then be rehung at the new location. Additionally, this type of solution normally requires a ladder in order to remove and relocate the tiles.

In light of the above, there exists a need for a ceiling system from which objects may hang which allows the objects to be easily movable and adjustable.

It is, therefore, an object of the present invention to provide a ceiling suspension system in which the objects hanging therefrom are readily moved to various locations.

It is a further object of the present invention to provide a ceiling suspension system that is readily adjustable to allow objects of various sizes to be hung at various heights and locations.

It is another object of the present invention to provide a ceiling suspension system that is readily adjustable to allow for partial or total relief of weight from the human body through support provided by the suspension system.

SUMMARY OF THE INVENTION

The present invention accomplishes the above-mentioned goals by providing an adjustable ceiling system comprising a grid which includes grooves interrupted by recesses. At least one retainer is held within the grooves. The retainer(s) move along the grooves and becomes seated in recesses disbursed throughout the grooves. A suspension means depends from the retainer to allow objects to suspend therefrom. The suspension means and associated retainer moves freely along the grooves and become seated in the recesses.

The ceiling suspension system may be constructed as a packaged unit and then installed in a portion of a room. It also may be constructed in a unitized fashion to allow variability at point of installation.

BRIEF DESCRIPTION OF THE FIGURES

The accompanying drawings, which are incorporated in and form part of the specification, illustrate an embodiment of the present invention and, together with the description, serve to explain the principles of the invention. In the drawings.

DETAILED DESCRIPTION OF THE PREFERRED EMBODIMENTS

Reference will be made in detail below to the preferred embodiment of present invention illustrated in the accompanying drawings. It should be noted that similar or identical structure is identified using identical reference numbers.

Figure 1:
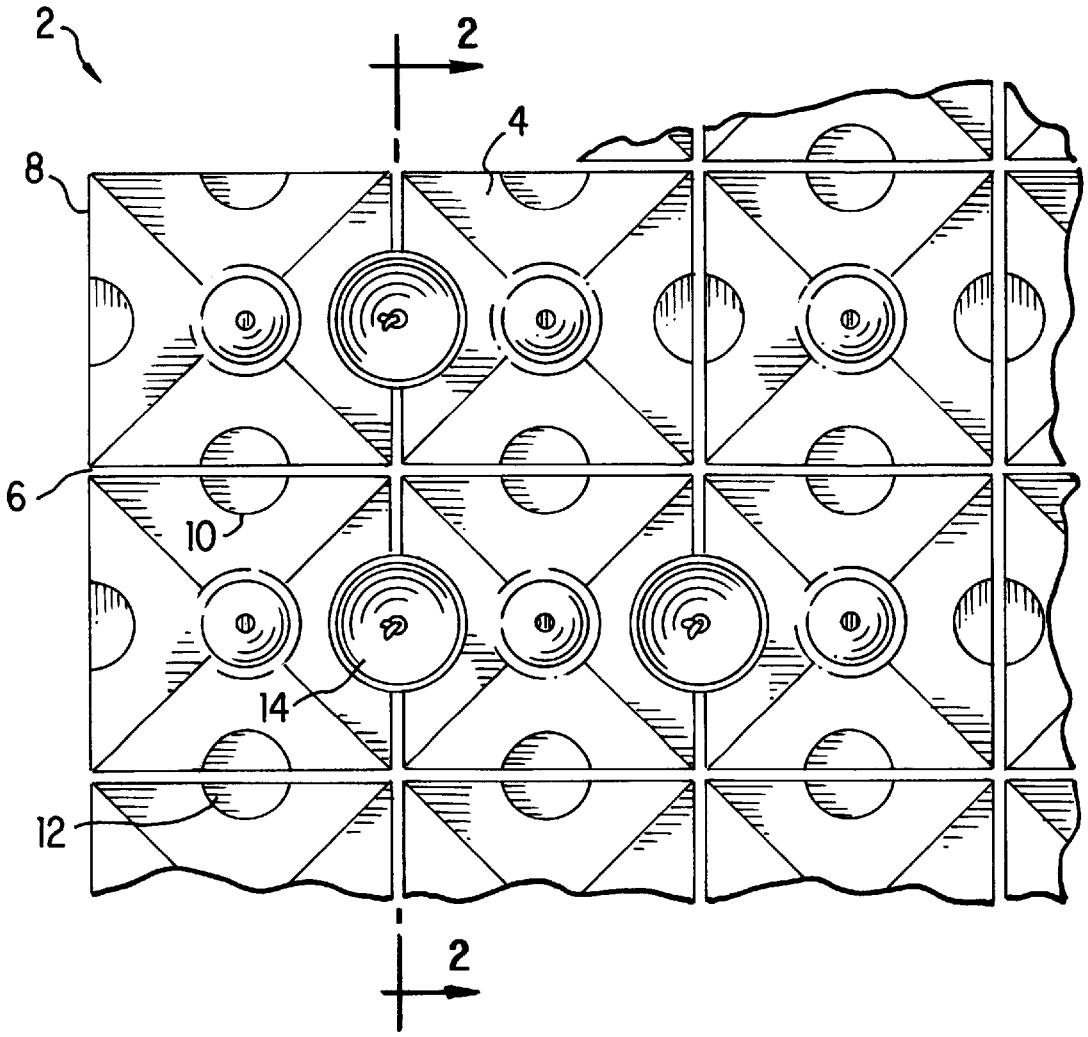
FIG. 1 is a plan view of the ceiling system from above.
Figure 2:
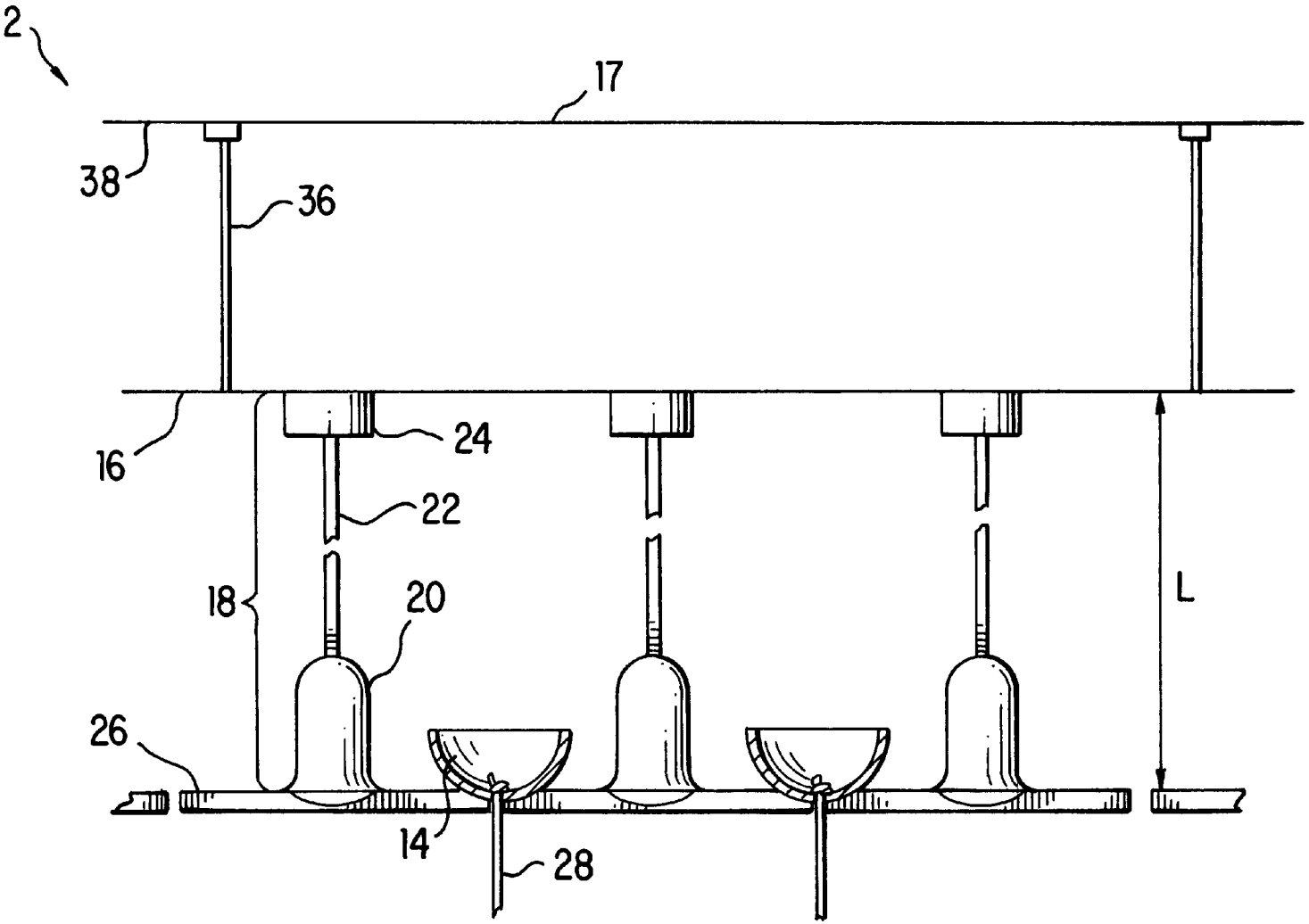
FIG. 2 is a cross-sectional view taken along line 2—2 of FIG. 1.

Referring now to a preferred embodiment, FIG. 1 generally shows a plan view of a suspended ceiling arrangement 2. A plurality of ceiling tiles 4 are installed adjacent to one another. Grooves 6 are formed by tile edges 8 where ceiling tiles 4 meet. Recesses 10 are spaced along grooves 6 and are preferably formed where two half recesses 12 from adjacent ceiling tiles 4 meet. However, recess 10 may be formed from just one ceiling tile 4. Recesses 10 are preferably shaped as a portion of the negative impression of a retainer 14, which sits in a recess 10 at a desired location for hanging. For example, if retainer 14 is a half-sphere as shown in FIG. 2, recesses 10 preferably would be a portion of an inverted half-sphere such that retainer 14 would sit in recess 10. However, recesses 10 could be of any shape. Several retainers 14 may be utilized, each sitting in a recess 10 and used in combination to hang an object or several objects. Retainers 14 move along grooves 6 to other recesses 10 for easy relocation of the hanging object(s).

Figure 3:
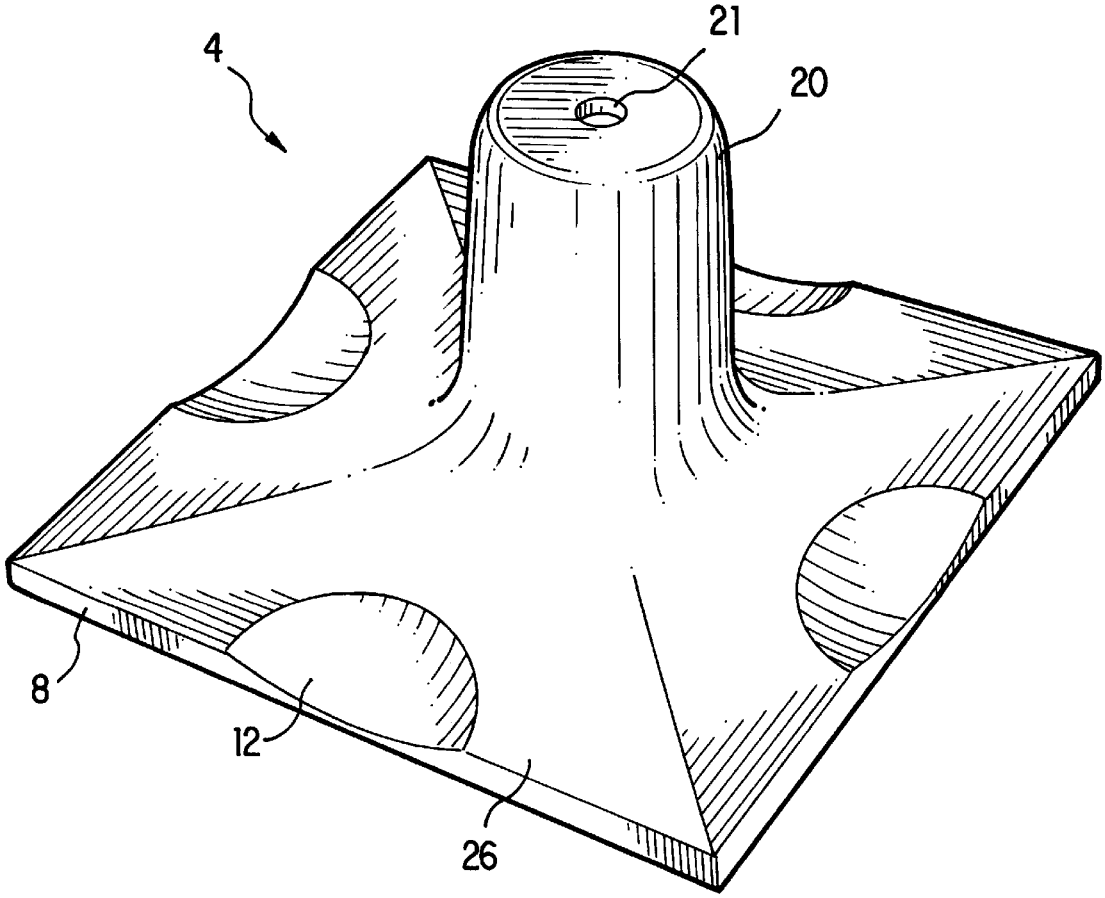
FIG. 3 is a perspective view of a tile in the ceiling system.

As shown in FIG. 2, a cross sectional view taken along line 2—2 of FIG. 1, ceiling tiles 4 are suspended from a structure 16 by way of connections means 18. Connection means 18 may comprise a stem 20, a rod 22, and a coupling 24. In a preferred embodiment, stem 20 is monolithic with each tile 4 as shown in FIG. 3. However, stem 20 could be a separate piece coupled to tile 4. Stem 20 extends upwardly from a top surface 26 of ceiling tile 4 towards structure 16. Rod 22 is coupled to stem 20 via aperture 21 (shown in FIG. 3) and extends upwardly further towards structure 16. Coupling means 24 connects rod 22 to structure 16, thereby supporting each tile 4 in suspended ceiling arrangement 2. In a preferred embodiment, suspended ceiling arrangement 2 connected to structure 16 is prefabricated. The unit is delivered and structure 16 is coupled to building structure 17. Any sufficiently sturdy method for coupling structure 16 to building structure 17 may be utilized. For example, rods 36 may be coupled to structure 16 and coupled to building structure 17 via anchor bolts 38. Length L is minimized to allow sufficient space above structure 16 for items such as ductwork, plumbing, and electrical conduits. Additionally, structure 16 requires few connection points to building structure 17, thereby increasing the free space above the suspended ceiling arrangement 2, rather than having connection means 18 from each tile 4 extended to building structure 17. Alternatively, in limited areas of a room, structure 16 could be eliminated and connection means 18 coupled to building structure 17.

Also shown in FIG. 2, retainers 14 are supported by suspended ceiling arrangement 2, normally in recesses 10 or in grooves 6 while being moved. Retainers 14 are shaped to fit in recesses 10. For example, retainers 14 could be a half-sphere shape in the preferred embodiment. Suspension means 28 from which objects may be hung depends from retainer 14. Suspension means 28 may be string, wire, a rod, unistrut, or any other structural means from which objects may hang. Suspension means 28 may be adjustable to allow objects to be hung at different heights. Additionally, suspension means 28 may be enhanced by a known line control unit that permits an item attached to suspension means 28 to be pulled down and then retreat out of the way when released.

The ceiling system may be constructed of different materials depending on the objects to be held. For example, if used for the display of toys and dolls, structure 16 could be plywood with lightweight suspension means 26 and connection means 18. However, if used for a heavier load, structure 16 could be of a metal construction with sturdier suspension means 26 and connection means 18.

Tiles 4 may be of any size, depending on the application. Tiles 4 may also be any shape, but generally will be rectangular or square. Different shapes and sizes may be combined within the same ceiling arrangement 2 depending on the desired grid layout for grooves 6 and location of recesses 10.

Figure 4:
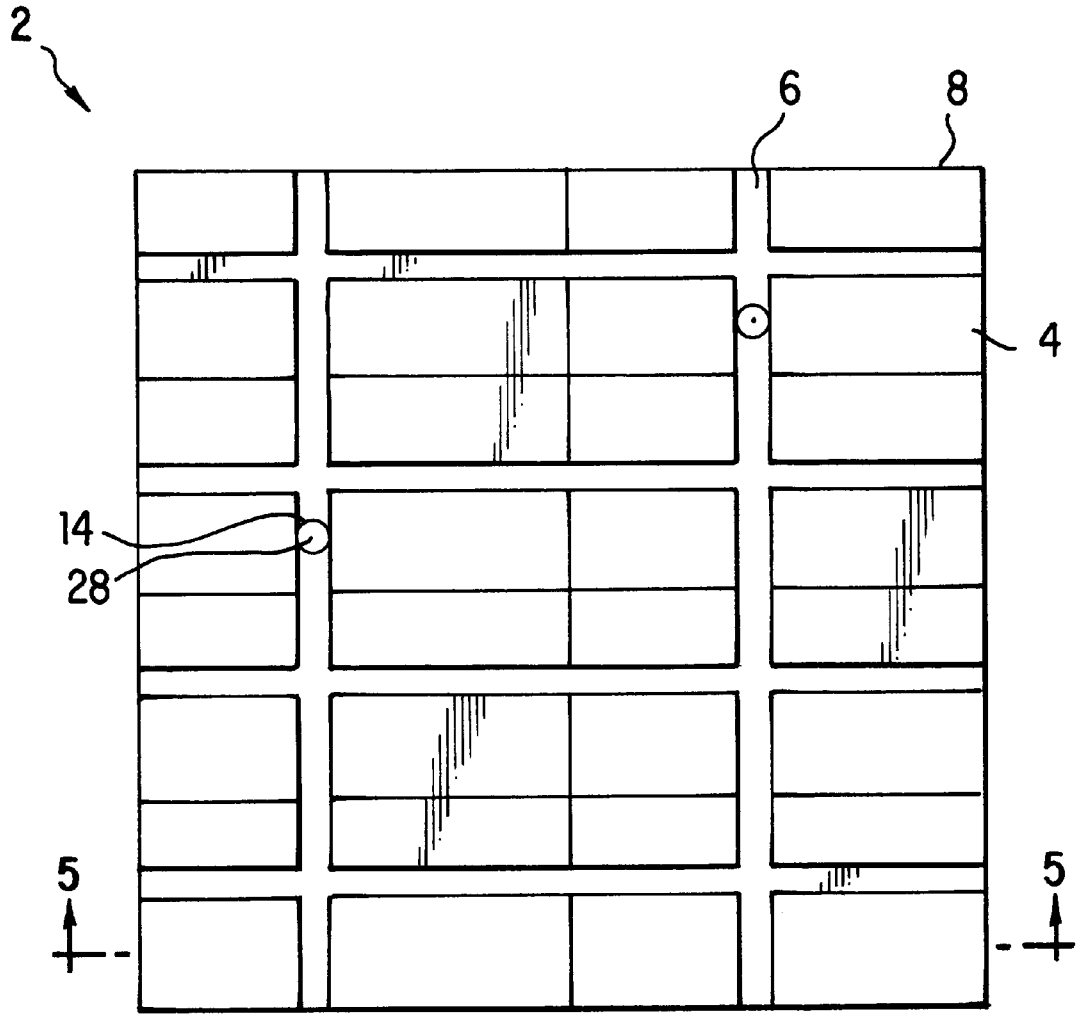
FIG. 4 is a plan view of an alternative embodiment of the ceiling system shown from below.
Figure 5:
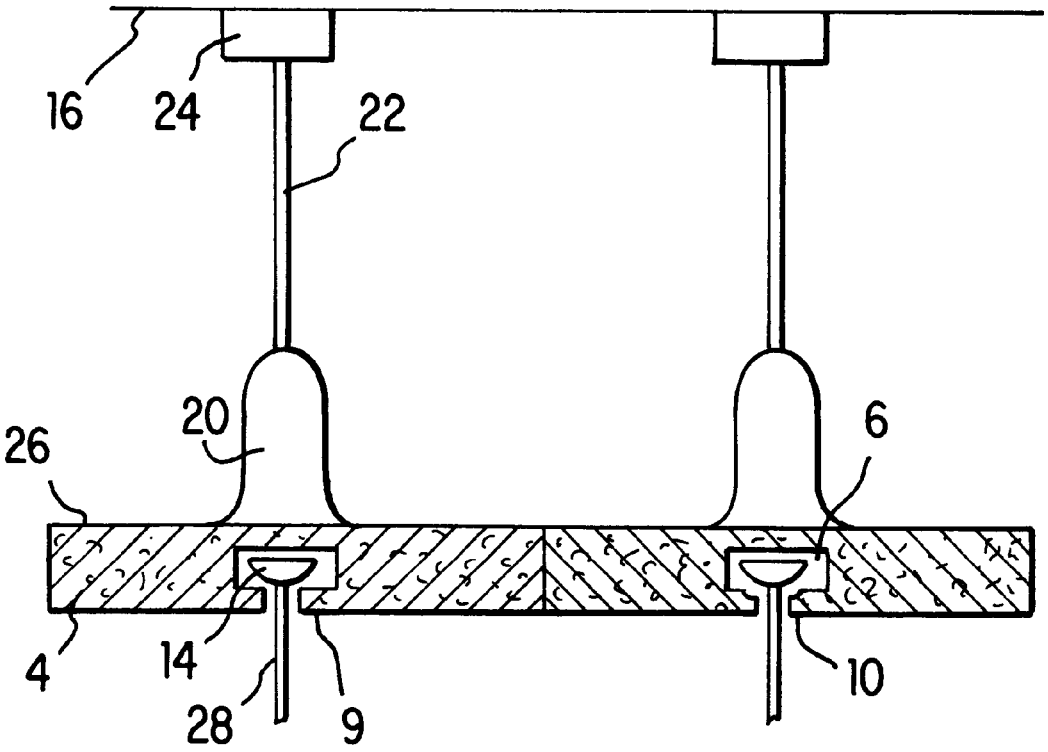
FIG. 5 is a cross-sectional view of an alternative embodiment of the ceiling system taken along line 5—5 of FIG. 4.

In an alternative embodiment of the present invention shown in FIGS. 4 and 5, grooves 6 would not be formed by the edges of the ceiling tiles. Instead, grooves 6 would be formed as part of the tile itself. Grooves 6 include a flange 9 on each side to support retainers 14. Each flange 9 is shortened or narrowed to form recesses 10 where retainers 14 sit at a desired location. Retainers 14 ride along grooves 6 at a certain height and drop slightly when seated in recesses 10 due to the narrowed or shortened flanges 9. The remaining features of the invention are unchanged from the description of a preferred embodiment and will therefore not be repeated.

Figure 6:
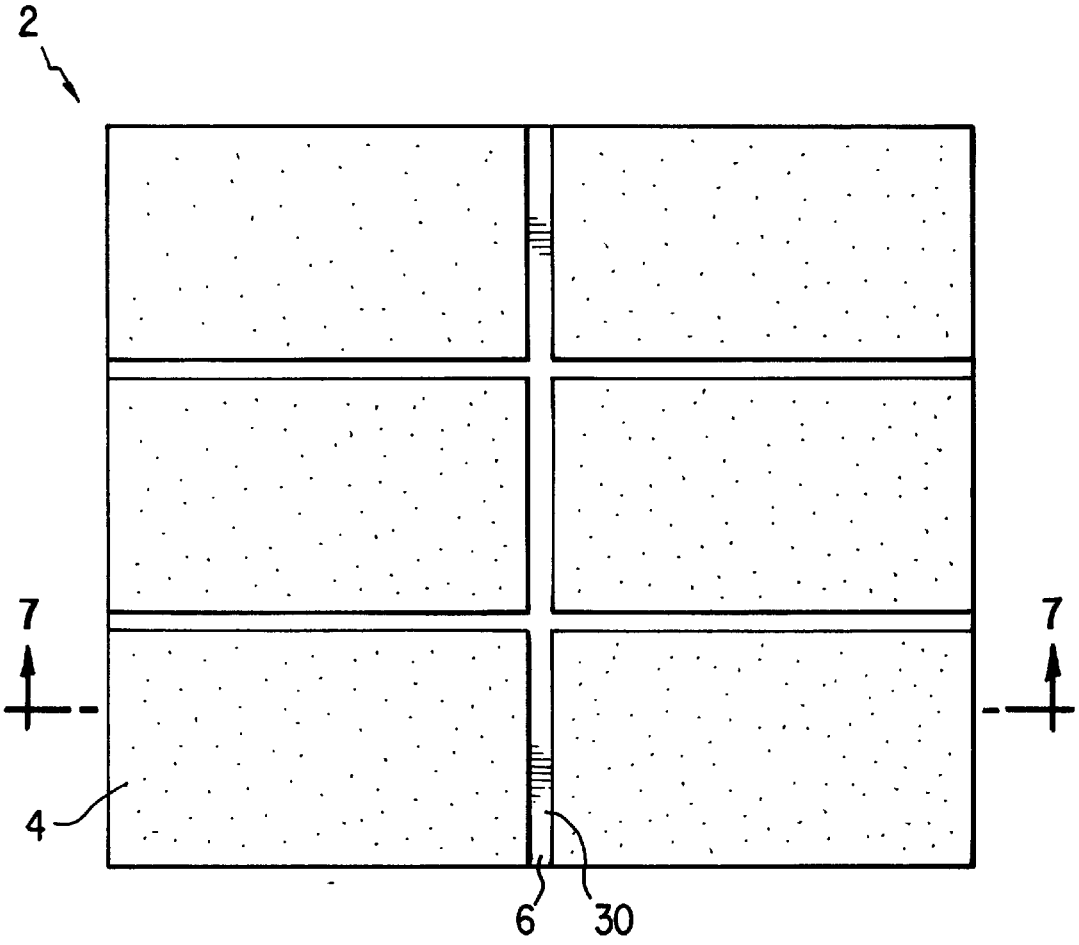
FIG. 6 is a plan view of an alternative embodiment of the ceiling system shown from below.
Figure 7:
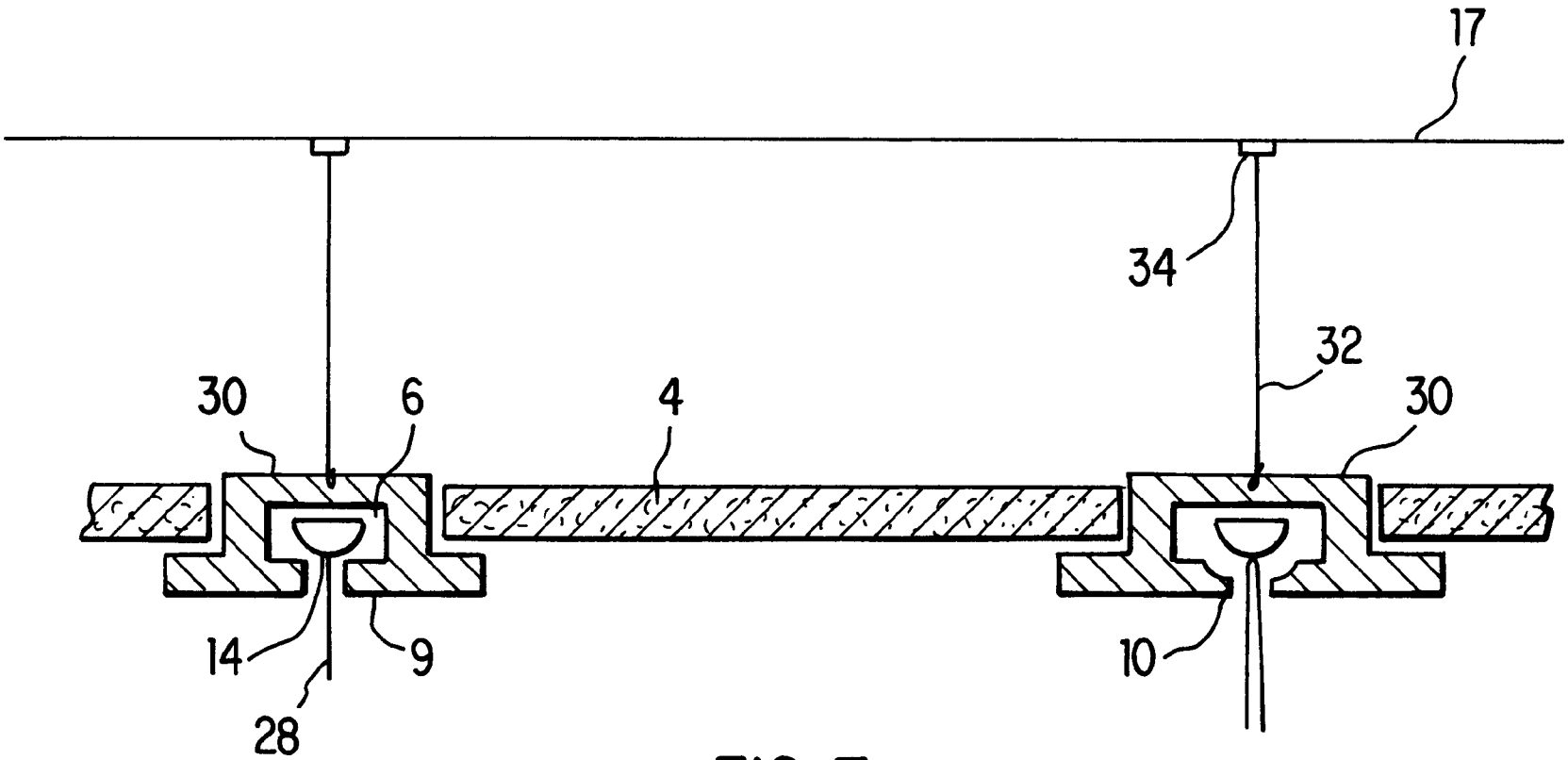
FIG. 7 is a cross-sectional view of an alternative embodiment of the ceiling system taken along line 7—7 of FIG. 6.

In another embodiment of the present invention shown in FIGS. 6 and 7, ceiling tiles 4 are standard acoustical tiles hung in a grid system. However, splines 30 which hold the tiles are constructed such that they include a groove 6. Retainers 14 are held within groove 6, with suspension means 28 hanging therefrom. Flanges 9 on each side of groove 6 supports retainer 14. Flanges 9 in spline 30 are shortened or narrowed to form recesses 10 to hold retainer 14 at a desired location. Retainers 14 ride along flanges 9 within groove 6 at a certain height and drop slightly to become sealed in recesses 10 due to the narrowed or shortened flanges 9. Spline 30 can be hung from building structure 17 in a conventional fashion. For example, tie wire 32 can be coupled to spline 30 and also coupled to an anchor bolt 34 or similar device which is coupled to building structure 17. The advantages of this alternative embodiment are that it allows a conventional suspended ceiling installation and occupies less space above the ceiling than other embodiments.

There are many possible applications for this type of system. For example, it could be used for displays of merchandise in a store. It could also be used for special lighting for art displays. It could also be used for traction patients to conveniently allow for a variety of positions. The system could also be adapted for an assembly line configuration in which the retainers are mounted in a movable unit that moves the product hanging therefrom along different stages of the manufacturing process.

What is claimed is:

1. A ceiling suspension system comprising:

a first tile;

a second tile adjacent said first tile, wherein said first tile and said second tile form a groove therebetween;

a retainer having a suspension device coupled thereto wherein said suspension device extends through said groove and said retainer is slidable along said groove; and a recess formed along said groove by at least one of said first tile and said second tile for seating said slidable retainer.

2. The ceiling suspension system of claim 1, wherein said recess is a portion of a half sphere.

3. The ceiling suspension system of claim 1, wherein said retainer is a half sphere oriented to sit in said recess.

4. A ceiling suspension system, comprising:

a tile with a top surface and a bottom surface;

a groove formed in said bottom surface of said tile; and a retainer having a suspension device coupled thereto, wherein said suspension device extends through said groove and wherein said retainer is slidable along said groove.

5. The ceiling suspension system of claim 4, wherein said tile is suspended from a structure via a connector.

6. The ceiling suspensions system of claim 4, further comprising a recess within said groove for seating said retainer.

7. A ceiling suspension system of clime 4, wherein said groove includes flanges for holding said retainer.

8. The ceiling suspension system of claim 7, further comprising a recess for seating said retainer formed by shortening or narrowing said flanges.

* * * * *